US010283841B2

(12) United States Patent
Lubin et al.

(10) Patent No.: US 10,283,841 B2
(45) Date of Patent: May 7, 2019

(54) WIRELESS ANTENNA

(71) Applicant: Shure Acquisition Holdings, Inc., Niles, IL (US)

(72) Inventors: Zachary Lubin, Niles, IL (US); Michael Le, Niles, IL (US); Paul Mark Jacobs, Evanston, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

(21) Appl. No.: 15/363,897

(22) Filed: Nov. 29, 2016

(65) Prior Publication Data

US 2018/0151944 A1 May 31, 2018

(51) Int. Cl.

| | |
|---|---|
| ***H01Q 1/48*** | (2006.01) |
| ***H01Q 1/22*** | (2006.01) |
| ***H01Q 1/38*** | (2006.01) |
| ***H01Q 1/24*** | (2006.01) |
| ***H01Q 1/42*** | (2006.01) |
| ***H01Q 9/28*** | (2006.01) |
| ***H01Q 9/40*** | (2006.01) |
| ***H01Q 21/28*** | (2006.01) |
| ***H01Q 21/30*** | (2006.01) |
| ***H01Q 5/10*** | (2015.01) |
| ***H01Q 5/357*** | (2015.01) |

(52) U.S. Cl.

CPC ..... *H01Q 1/2291* (2013.01); *H01Q 1/243* (2013.01); *H01Q 1/38* (2013.01); *H01Q 1/42* (2013.01); *H01Q 1/48* (2013.01); *H01Q 5/10* (2015.01); *H01Q 5/357* (2015.01); *H01Q 9/28* (2013.01); *H01Q 9/40* (2013.01); *H01Q 21/28* (2013.01); *H01Q 21/30* (2013.01)

(58) Field of Classification Search

CPC ..... H01Q 5/02; H01Q 5/0003

See application file for complete search history.

(56) References Cited

U.S. PATENT DOCUMENTS

| | | | | |
|---|---|---|---|---|
| 5,592,184 | A | 1/1997 | Cassel et al. | |
| 6,680,708 | B2 | 1/2004 | Yamaki | |
| 7,414,587 | B2 | 8/2008 | Stanton | |
| 2003/0189522 | A1 * | 10/2003 | Zeilinger | H01Q 9/0421 343/702 |

(Continued)

FOREIGN PATENT DOCUMENTS

| | | | |
|---|---|---|---|
| CN | 1669182 | A | 9/2005 |
| EP | 2067209 | A1 | 6/2009 |

(Continued)

OTHER PUBLICATIONS

Feb. 8, 2018—(PCT) International Search Report and Written Opinion—App PCT/US2017/061105.

Nov. 27, 2018—(TW) Search Report—App 106141527.

*Primary Examiner* — Graham P Smith

(74) *Attorney, Agent, or Firm* — Banner & Witcoff, Ltd.

(57) ABSTRACT

An antenna for supporting a wireless system, which can in one example, be operable in two industrial, scientific and medical ("ISM") bands, may include a first radiator and a second radiator, and a single feed transmission section coupled to the first radiator and the second radiator. The antenna can, for example, be formed of a unitary planar structure. The antenna may be configured to fit within a chassis, which in one example, can be a chassis for a wireless receiver in a microphone.

18 Claims, 10 Drawing Sheets

(56) References Cited

U.S. PATENT DOCUMENTS

| | | | |
|---|---|---|---|
| 2007/0018896 | A1 | 1/2007 | Chen et al. |
| 2008/0266189 | A1 | 10/2008 | Wu |
| 2012/0169568 | A1 | 7/2012 | Oh et al. |
| 2015/0077303 | A1 | 3/2015 | Lin |

FOREIGN PATENT DOCUMENTS

| | | | |
|---|---|---|---|
| JP | 10247806 | A | 9/1998 |
| WO | 2004025778 | A1 | 3/2004 |
| WO | 2005029642 | A1 | 3/2005 |
| WO | 2008100660 | A1 | 8/2008 |

* cited by examiner

WIRELESS ANTENNA

RELATED APPLICATIONS

The disclosure herein relates to U.S. Pat. No. 7,414,587, issued on Aug. 19, 2008, which is fully incorporated by reference herein for any non-limiting purposes.

FIELD

The disclosure herein relates to an antenna for use in a wireless receiving or transmitting system, including a wireless microphone.

BACKGROUND

In a wireless microphone, one or more antennas can be mounted to the outside of a chassis of the microphone and/or have ports into which external antennas can be connected directly or by an RF (radio frequency) shielded cable. In order to be optimally matched to varying transmitter polarization directions and environmental conditions, external antennas with rotating attachments to the receiver chassis can be used, thus allowing the user to orient the antennas for optimal reception. However, in certain instances this approach may be costly and may result in mechanical complexity and reliability concerns. Moreover, in certain instances, a user typically may not know how to orient the antennas properly and can actually degrade reception if the user selects a poor orientation. Moreover, in certain instances, an externally mounted antenna may be prone to be disturbed from the desired position or even damaged. Additionally, in certain examples, it may be desirable operate the antenna in more than one frequency band.

BRIEF SUMMARY

This Summary provides an introduction to some general concepts relating to this disclosure in a simplified form that are further described below in the Detailed Description. This Summary is not intended to identify key features or essential features of the invention.

Aspects of this disclosure relate to an antenna for supporting a wireless system operable in two industrial, scientific and medical ("ISM") bands. The antenna may include a first radiator configured to operate in a first ISM band and a second radiator configured to operate in a second ISM band, and a single feed transmission section coupled to the first radiator and the second radiator. The antenna may be configured to fit within a chassis, which in one example, can be a chassis for a wireless receiver in a microphone.

BRIEF DESCRIPTION OF THE DRAWINGS

The foregoing summary, as well as the following detailed description, is better understood when read in conjunction with the accompanying drawings, in which like reference numerals refer to the same or similar elements in all of the various views in which that reference number appears. The drawings are included by way of example, and not by way of limitation with regard to the claimed invention.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "right," "left," "frontside," "backside," "top," "base," "bottom," "side," "forward," and "rearward" and the like may be used in this specification to describe various example features and elements, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the claims.

Figure 1A:
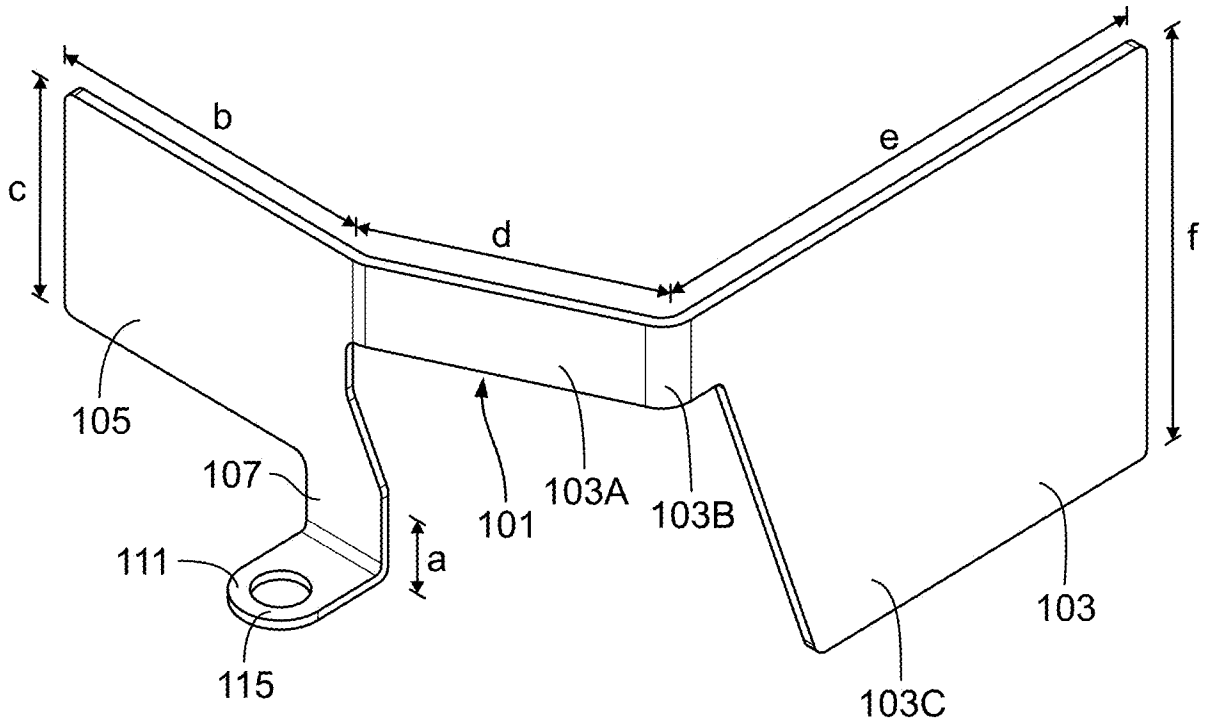
FIG. 1A shows a perspective view of an example antenna according to an aspect of the disclosure.
Figure 1C:
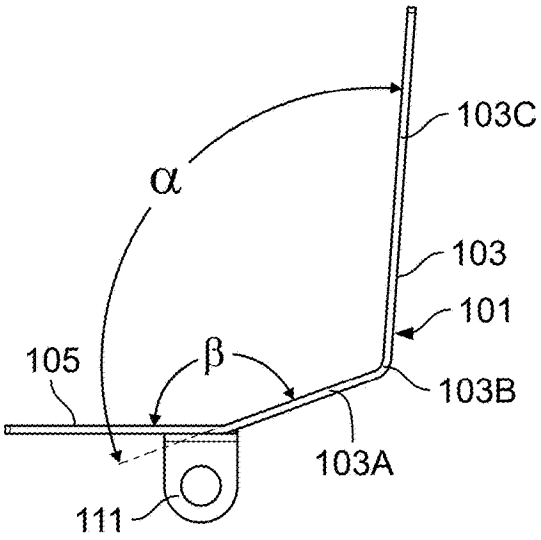
FIG. 1C shows a top view of the example antenna of FIG. 1A.
Figure 1B:
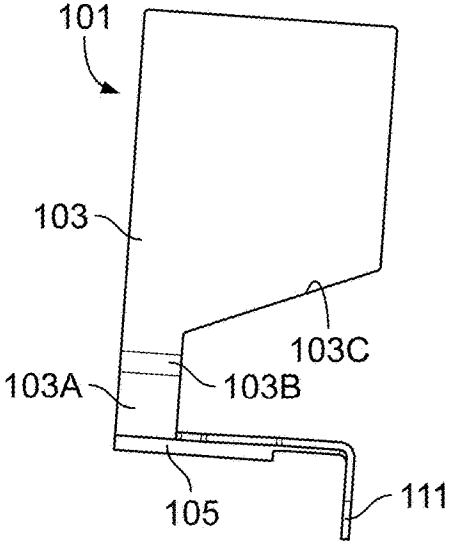
FIG. 1B shows a side view of the example antenna of FIG. 1A.
Figure 1D:
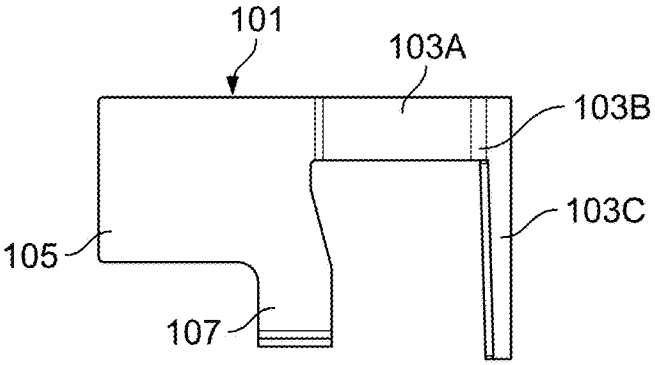
FIG. 1D shows a front view of the example antenna of FIG. 1A.

FIGS. 1A-1D shows various views of an example antenna 101, where FIG. 1A shows a perspective view of an exemplary antenna 101, FIG. 1B shows a side view, FIG. 1C shows a top view, and FIG. 1D shows a front view. As shown in FIGS. 1A-1D, the antenna 101 can include two separate antennas or first radiator 103 and second radiator 105 that are connected to a common single feed post (feed transmission line) 107 and single feed point 115 that forms the conductive connection 111 to a circuit board 109 discussed below. In this example, the first radiator 103 and the second radiator 105 can be configured to operate in different bandwidth regions. For example, the first radiator 103 can be configured to operate in the 900-928 MHz region, and the second radiator 105 can be configured to operate in the 2400-2485 MHz region. In one example, the first radiator 103 can have a greater surface area than the second radiator.

The single feed point 115 and the single feed post 107 are electrically coupled to first radiator 103 and second radiator 105 where feed post 107 supports both the electrical coupling of the antenna to a circuit board 109 as well as being part of the second radiator. Locating the radiators 103, 105 on opposite sides of the feed point 115 help to decouple the radiators such that each radiator 103, 105 can be tuned to achieve a particular band and minimizes the interference effects on each other. Therefore, the antenna 101 can effectively operate as a pair of diversity antennas 103, 105 on a receiver to operate in the dual ISM radio bands of 902-928 MHz and 2400-2485 MHz with a single feed post 107 to each radiator 103, 105. Each radiator 103, 105 utilizes a wide, conductive sheet of material extending from the feed post 107, which enables the antenna 101 to achieve its operating frequency and wide bandwidth in an enclosure of the microphone with height restrictions. In this example, the vertical height of the antenna 101 can be reduced to sufficiently fit, yet still achieve operation in the ISM bands. In this way, the exemplary antenna 101 can be configured as a conformable dual-band planar inverted monopole for small form-factor vertical mounting on printed circuit boards, which can provide dual-polarization broadband performance in a wireless microphone system.

Referring again to FIGS. 1A-1D, the first radiator 103, which is configured to receive signals in the 902-928 MHz, may comprise multiple tabs 103A, 103B, 103C, which generally form an "L" shape in the top view of FIG. 1C. Tab 103A can consist of an elongated rectangular portion. Tab 103B can consist of a square portion. Also, tab 103C can be a quadrilateral shape where one of the angles connecting the sides can be greater than 90°. Tab 103C can include a larger area than tabs 103A and 103B.

Figure 3:
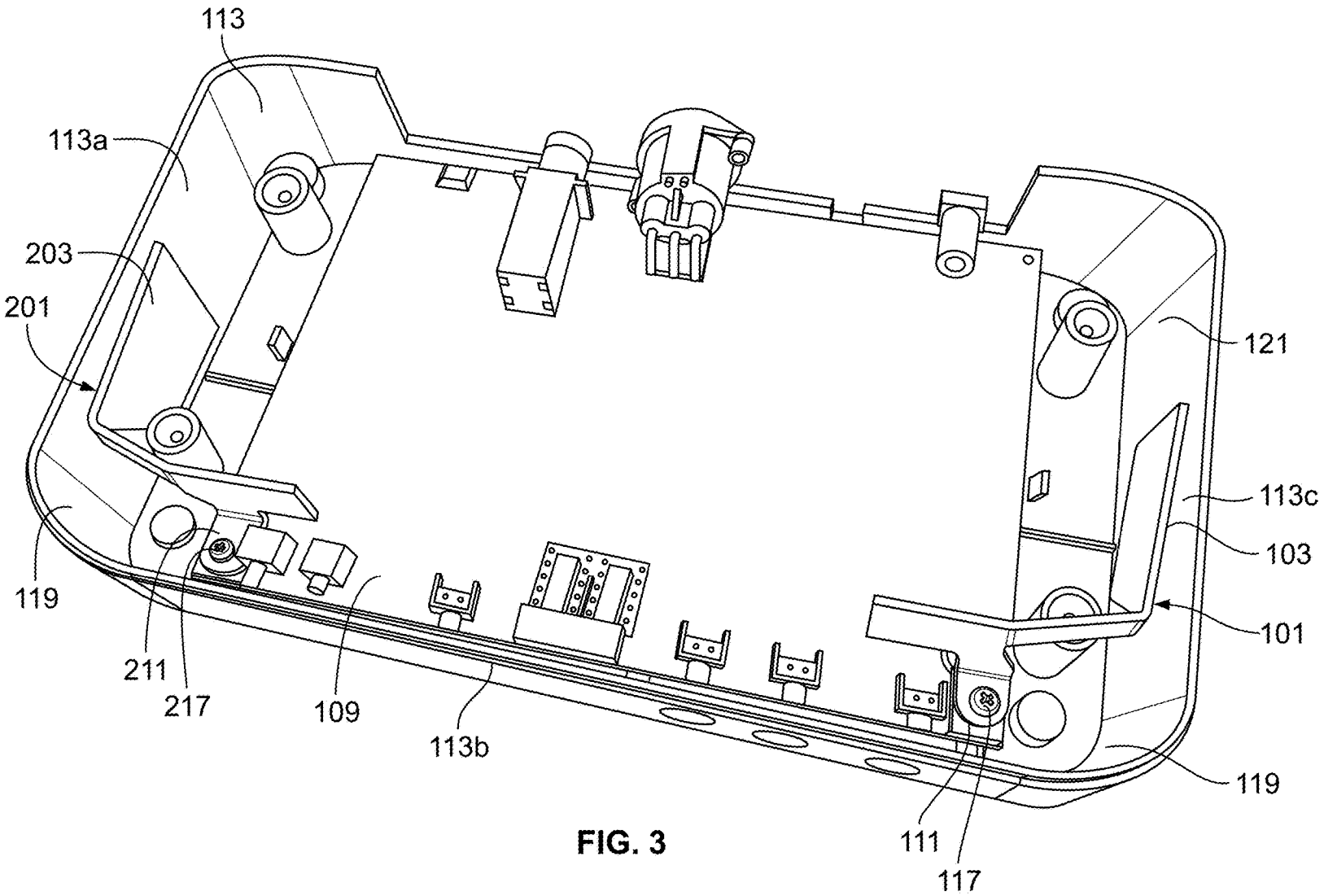
FIG. 3 shows a portion of a microphone chassis incorporating the example antennas of FIGS. 1A-1D and 2A-2C.

The shape and low height of the first radiator 103 can be achieved by inverting the first radiator 103 in an "L" shape and forming the tab 103C of a larger area than tabs 103A and 103B. In certain examples, a ground plane is not required underneath and may degrade the performance of the first radiator (corresponding to the lower frequency band) while the ground plane enhances the performance of the second radiator (corresponding to a higher frequency band). This characteristic may be advantageous in some embodiments, where the metal sheet is bent around the corner of the chassis as shown in FIG. 3.

As shown in FIG. 1A, tab 103A can have a length d, tab 103C can have a length e, and tab 103C can have a height f. In one example, the length d of tab 103A can be 15.1 mm. However, the length d can be formed shorter to move the frequency response up in both frequency bands. In one example, the length d can range from 10 to 20 mm. In one example, the length e of the tab 103C can be 34 mm. However, the length e can range from 30 to 40 mm, and in one example, shortening the length e can cause the frequency response to increase. Also the height f of tab 103C, in one example, can be 25 mm, and shortening the length f can cause the frequency response to increase.

Each of the tabs 103A, 103B, 103C can be angled or bent relative to the single feed post 107 and relative to one another as shown in FIG. 1C. In one specific example, angle $\alpha$ can be approximately 114°. In other examples the angle $\alpha$ can be an angle at or between 100° to 135° to accommodate for various spaces within a chassis. In certain examples, altering the angle $\alpha$ does not significantly influence the gain characteristics of the antenna. Additionally, in one specific example, the angle $\beta$, which is the angle between tab 103A of the first radiator 103 to the second radiator 105 can be 160°. In another example, the angle $\beta$ can be at or between 140° to 180°. In certain examples, altering the angle $\beta$ does not significantly influence the gain characteristics of the antenna.

The second radiator 105, which is configured to receive signals in the 2400-2485 MHz range can approximate a square shape, where the height c is similar to the width b. In one particular example, the width can be 19 mm, and the height c can be 16 mm. However, it is contemplated that the width can range from 15 to 25 mm, and the height can range from 10 to 20 mm. In this example, shortening the width b or the height c can increase the frequency response of the antenna 101.

In one example, the feed post can be formed with a notch or cutout area. Alternatively or additionally, the feed post 107 can be formed as a rectangular tab portion, and in one example, can have a height (a) of 8 mm. However, the height a of the feed post 107 can range between 3 mm and 15 mm. Moreover, in certain examples, shortening the height a of the feed post 107 increases the frequency response of the antenna.

The exemplary antenna 101 can be formed of a single piece of stamped sheet metal, which in certain examples reduces costs and provides for ease of manufacturing. In one example, the sheet metal can be formed of a 0.5 mm thick cold rolled steel or other suitable sheet metal. The finish may include a copper flash, electroless nickel plating of 1-2.5 microns thick. Forming the antennal 101 of sheet metal may provide for a unitary planar structure as shown in FIGS. 1A-3B.

In alternative examples, the corners of the first radiator 103 and the second radiator 105 including the corners of the various tabs 103A, 103B, 103C can be formed rounded instead of square. In addition various notches or cutouts can be included in the antenna 101 to facilitate the bending and/or rolling of the sheet metal when forming the antenna 101.

Formation of the antenna from sheet metal allows a wide sheet conductor providing for a broadband performance. In other examples, however, it is also contemplated that the antenna can be formed of wire. For example, the antenna may be formed of a closed shape wire, e.g., rectangle, square, oval, rhombus, trapezoid and the like or other closed shape. In one example, the closed shape can be formed by bending a portion of a wire and connecting an end of the wire to a point such as a conductive connection between the ends of the wire. This, in one example, can be soldered connection, screw connection or adhesive connection. However, other types of connections may be used in order to provide electrical connectivity.

While the embodiments shown in FIGS. 1A-1D support receiving a wireless signal from an external device (e.g., a wireless microphone), embodiments may support transmitting wireless signals to an external device, where the transmitting and receiving antenna characteristics are approximately the same for a given frequency value.

Figure 2B:
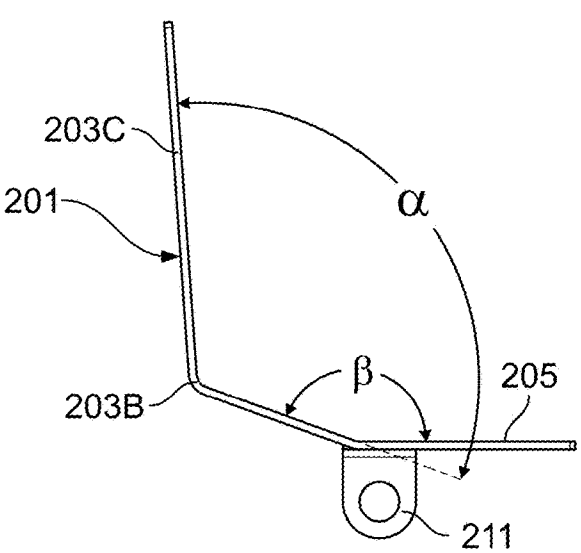
FIG. 2B shows a top view of the example antenna of FIG. 2A.
Figure 2A:
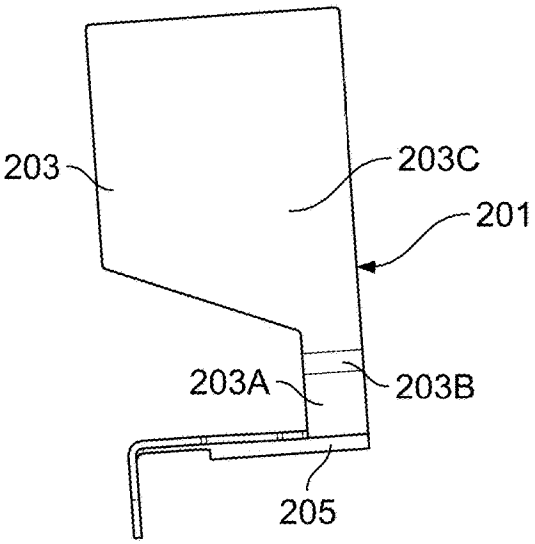
FIG. 2A shows a side view of another example antenna according to an aspect of the disclosure.
Figure 2C:
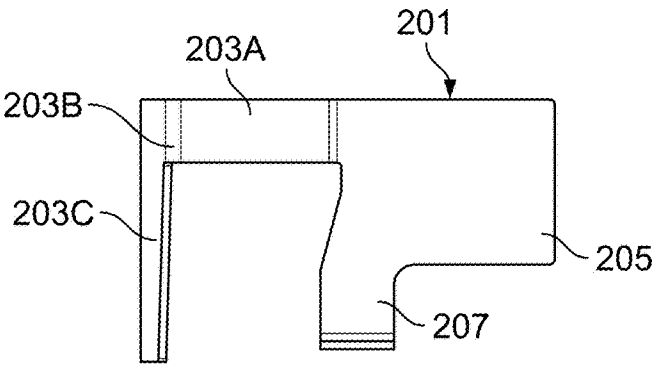
FIG. 2C shows a front view of the example antenna of FIG. 2A.

FIGS. 2A-2C show another example antenna 201. Antenna 201 can be identical to antenna 101 dimensionally and functionally, in which like reference numerals refer to the same or similar elements in all of the various views in which the reference number appears. Antenna 201, however, is a mirror image of the example antenna 101 where antenna 101 is a right-oriented antenna, and antenna 201 is a left-oriented antenna.

FIG. 3 shows example antennas 101, 201 located on a planar printed circuit board (PCB) 109, which are mounted within a chassis 113. In one example, the chassis can form part of a housing for a microphone or a housing for a wireless receiver. In one example, the chassis can be a plastic (or equivalent material) or a non-metallic material. In this example, two antennas 101, 201 can be used to provide diversity reception in a receiver setting. For example, the right-oriented antenna 101 and the left-oriented antenna 201 can be packaged within an enclosure 121 formed by the chassis 113 along with printed circuit board 109. The antennas 101, 201 in this example are duplicated in a wireless receiving system to support multiple receivers. However, it is contemplated that only one antenna 101 may be used or that the antennas may be used in a transmitter or transceiver setting. In this example, each antenna 101, 201 can include a similar profile where the antennas are mirror images of each other. Also in this example, the antennas can be mounted vertically.

The antennas 101, 201 can be electrically connected to the printed circuit board (PCB) 109, which supports a wireless receiving function, for example, for a wireless microphone receiver at conductive connections 111. In one example, the conductive connections 111, 211 of the antennas 101, 201 can be formed of a metal pad 123, which can act as a mounting pad 123 for the antennas 101, 201.

Figure 3A:
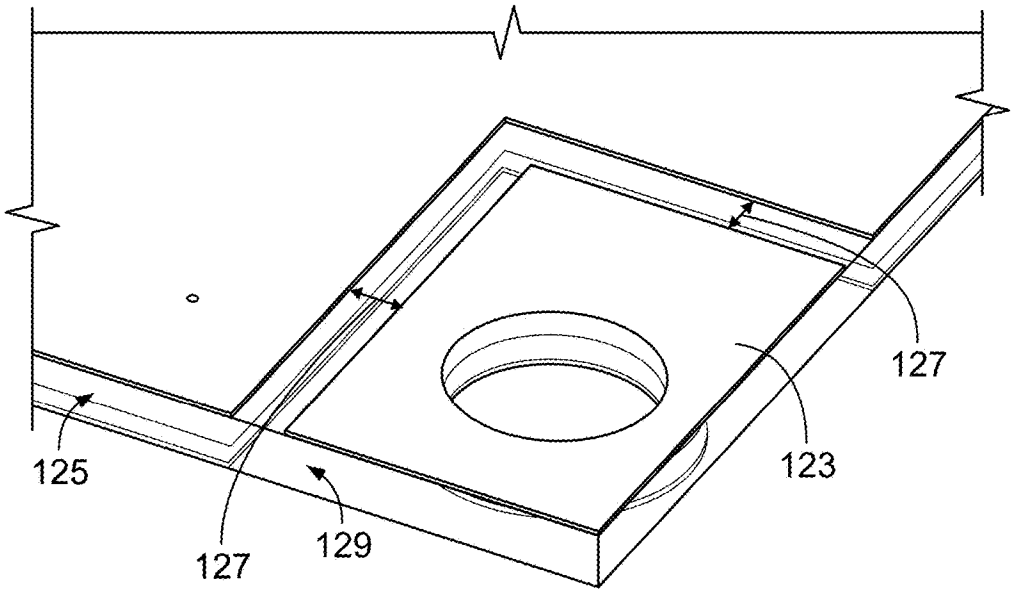
FIG. 3A shows an enlarged section of an example circuit board illustrating a mounting location of the example antenna.
Figure 3B:
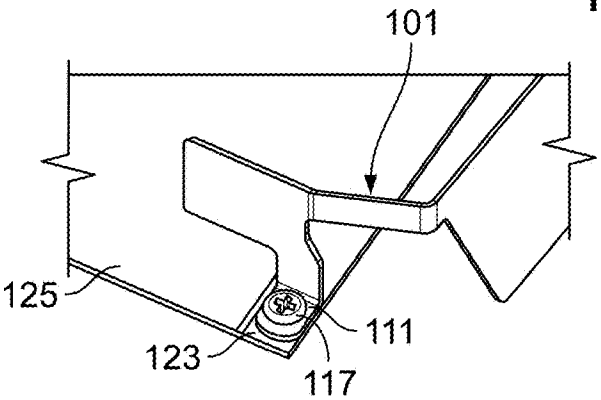
FIG. 3B shows another enlarged section of an example circuit board illustrating the mounting of the example antenna.

In one example, the antennas 101, 201 can be mounted on the circuit board by screws 117, 217 in the corner of the circuit board 109. However, in alternative examples, the conductive connections 111, 211 can be formed with a solder connection, electrical adhesive, or other suitable connection method. FIGS. 3A and 3B show enlarged schematics of the connection between the antennas 101, 201 and the circuit board 109. As shown in FIGS. 3A and 3B, the circuit board 109 can include the mounting pad 123 for receiving the antennas 101, 201. In one example, the antennas 101, 201 can be secured to the mounting pad 123 by a threaded fastener such as screws 117, 217. Other methods of attachment are also contemplated, such as welds, adhesive, rivets, etc. The mounting pad 123 can be formed of a dielectric substrate 129, and metal plates 125, which form an electrical ground, can fill the rest of the circuit board 109. However, in order for the antennas 101, 201 to radiate sufficiently, a gap 127 is formed between the mounting pad 123 and the remainder of the circuit board 109. The gap 127 is an area where the conductive material of the circuit board is removed on all layers. Nonetheless, the gap 127 can utilize valuable space that one could otherwise use to place components on the circuit board 109. Therefore, in certain instances, it may be desired to make the gap 127 as small as possible. In one example, the gap 127 can be 1.27 mm and can range from 1 mm to 5 mm. During operation, a signal is fed to the mounting pad 123 from the circuit board 109 and to the antennas 101, 201.

As illustrated in FIG. 3, through the adjustment of their geometry, the antennas 101, 201 can be configured to fit in and enclosed entirely in a low profile chassis 113 of a microphone, for example. As illustrated in FIG. 3, the antennas 101, 201, again which can be formed of sheet metal, are bent relative to the vertical axis of the antennas 101, 201 to fit within the corners 119 of the chassis 113 of the microphone. The multiple bends in the sheet metal forming the antennas 101, 201 permit the antennas 101, 201 to conform with a box-like shape of the chassis 113 of the microphone in that the angles and bends allow the antennas 101, 201 to conform with the tight corners of the chassis 113.

Also, as shown in FIG. 3, the first radiators 103, 203 can generally hang away from the edge of the printed circuit board 109 to reduce capacitive coupling due to their larger area and lower operating frequency. This creates spacing between the first radiators 103, 203 away from the circuit board 109 surface. The arrangement of the various tabs 103A-C, 203A-C help to create this arrangement as well as arrange the components to allow the antennas 101, 201 to fit snug into the corners of the chassis 113 rather than straight out from the circuit board 109.

For instance, the chassis or housing 113 can define a first wall 113*a*, a second wall 113*b*, and a third wall 113*c*. The first wall 113*a* can extend perpendicular to the second wall 113*b*, and the third wall 113*c* can extend perpendicular to the second wall 113*b*. For each of the antennas 101, 201, a first one of the multiple tabs 103A, 103B, 103C, 105, 203A, 203B, 203C, 205 can generally extend along the inside of the first wall 113*a* of the chassis 113 and second one of the multiple tabs 103A, 103B, 103C, 105, 203A, 203B, 203C, 205 can extend generally along the second wall 113*b* of the chassis 113. Additionally, it is contemplated that the antennas 101, 201 can be configured to conform to other chassis shapes by providing the antennas 101, 201 with different bends and geometries.

Additionally, as shown in FIG. 3, the first antenna 101 and the second antenna 201 can be configured to fit within the chassis 113. The antennas 101, 201 are provided with a short or low profile, which allows the antennas 101, 201 to fit within a shorter or lower profile chassis 113. Specifically, the antennas 101, 201 can be size-reduced antennas 101, 201 having broadband frequency responses and have low profiles so that antennas 101, 201 may be packaged within a plastic (or equivalent material) or non-metallic chassis. The vertical dimensions of the antennas 101, 201 are reduced to fit internally inside the chassis 113. The antennas 101, 201 can provide a reduction in vertical component length, for example, by increasing the area of the antennas 101, 201 in the horizontal direction. Also the circuit board 109 may define a circuit board plane, and each of the antennas first radiator and second radiator may define multiple radiator planes. Each of the multiple radiator planes can extend substantially or almost perpendicular to the circuit board plane.

The above example antennas 101, 201 may provide a simple construction and low cost structure, which also can provide for ease of tuning by modifying geometry. The antennas 101, 201 may also be adapted for any wireless system application depending on the desired configuration. The antennas 101, 201 also can provide for reception diversity in that multiple antennas 101, 201 can be provided in close proximity on the same circuit board 109. The example antennas 101, 201 may also provide an appropriate amount of gain and omni-like pattern characteristics, which may be more ideal for wireless microphone systems where the user can orient the microphone at different positions.

For example, a previous off-the-shelf chip antenna may take up significant circuit board area due to its size. Also a gap needs to be included around the antenna to separate ground plane fill and the pad/trace the chip is on, leaving just substrate material. If the circuit board already has a congested layout, attempting to fit in such an antenna can be quite challenging. In exemplary designs of the antenna 101, 201, a small 50 mil. (1.27 mm) gap is used, allowing efficient use of remaining circuit board surface area. Orienting the antennas 101, 201 vertically also reduces the circuit board space utilized by the antenna structures (e.g. vs. a fat planar chip).

Additionally, the design of the antennas 101, 201 require very little surface area on the circuit board 109 to mount because of their profiles. The antenna connections 111, 211 are made to the conductive pads 123 on the circuit board 109, and only a small gap 127 is included between the pad and the conductive ground plane of the circuit board 109. For instance, the vertical structure of the antenna allows for the minimization of the gap 127 and helps to creates additional area for additional circuitry use on the circuit board 109. In one example, the conductive connections 111, 211 can define a first area, and the first radiator and the second radiator can define a second area, where the first area can be less than the second area. In one example, the conductive pads 123 can be about 82 $mm^2$ (107 $mm^2$ including gaps) of the circuit board 109 to form the first area. In one example, the approximate area of the second area which includes the first radiator and the second radiator can be 1260 $mm^2$. In this example, therefore, the first area is only 8-9% of the second area or the total antenna area for each antenna 101, 102. In other examples, the first area can be 5% to 10% of the second area or the first area can be less than 20% of the second area. This allows very little ground plane removal area on the circuit board 109, which in one example, can have an area of approximately 12,400 $mm^2$. Therefore, the conductive pads including the gaps only take up less than 1% of the total surface area of the circuit board allowing for the remaining space to be used for circuit use or for other components.

While the antennas 101, 201 may be packaged in the same enclosure as the electronic circuitry of a wireless receiving system. It is also contemplated that the antennas 101, 201 could be packaged in a different enclosure or externally packaged or mounted to the chassis or printed circuit board 109. The antennas 101, 201 may also support different types of wireless receiver systems in addition to wireless microphones, including wireless microphone receivers, personal stereo monitor receivers, wireless PAI/presentation systems (e.g., Anchor systems), and stage mixing systems with integrated wireless microphone receivers. For example, a wireless portable P.A. speaker is composed of a built-in (integrated) VHF or UHF wireless receiver, audio amplifier, speaker(s), and typically an internal power pack where all components are within a single chassis.

Also, as a result of the antennas 101, 201 being internally implemented in the receiver chassis, the antennas 101, 201 can be protected from accidental damage and misuse that may result in personal injury. Also, with internally situating antennas 101, 201 in a chassis, there is less susceptibility to environmental concerns that result in corrosion that can have adverse effect on antenna performance.

Figure 7:
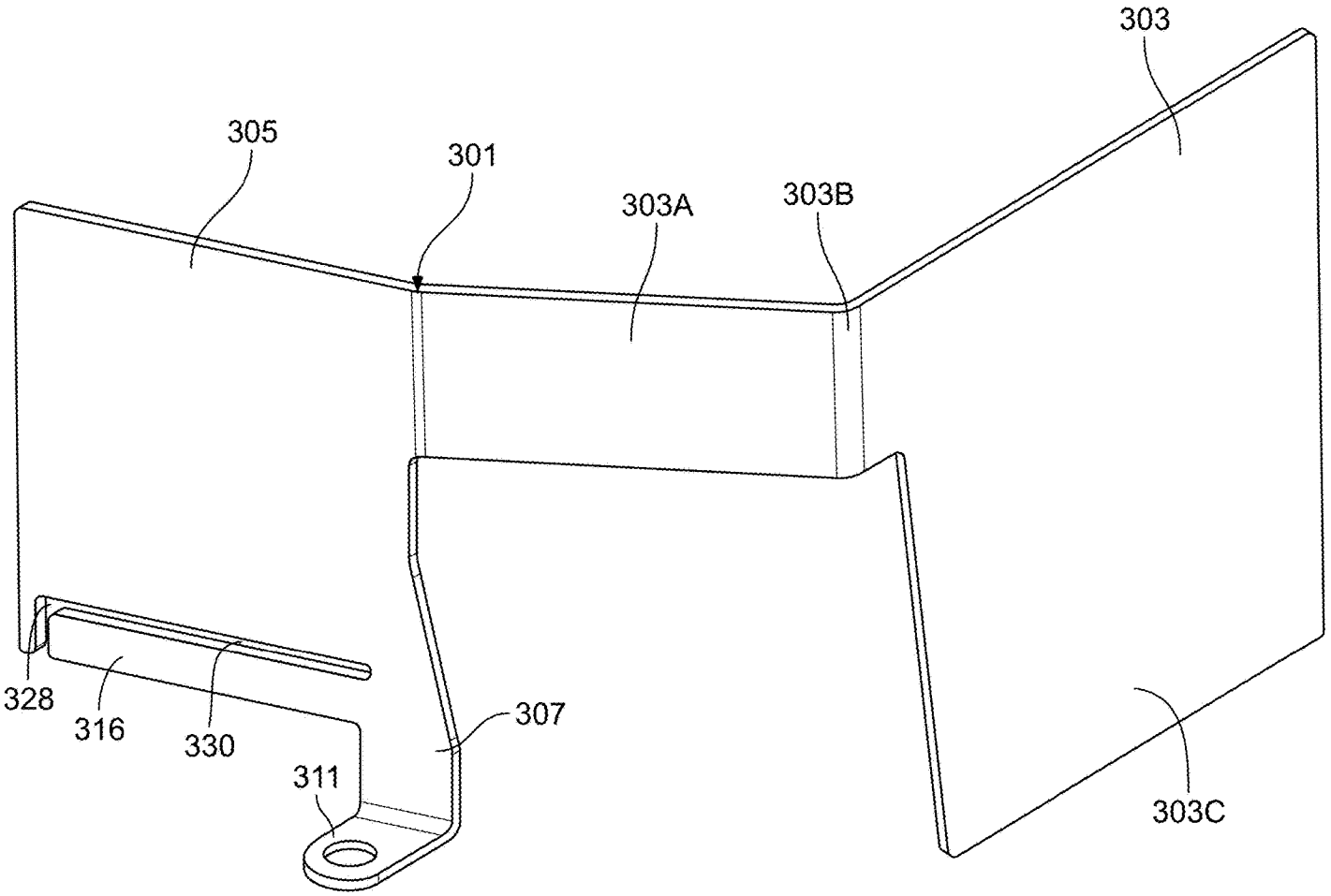
FIG. 7 shows a side view of another example antenna according to an aspect of the disclosure.

While the embodiments shown in FIGS. 1A-3B support ISM bands of 902-928 MHz and 2400-2485 MHz, other embodiments may support different dual frequency bands. For example, some embodiments may support a low UHF frequency band, high UHF frequency band, and/or cellular frequency band (e.g., 800 MHz, 900 MHz, 1800 MHz, or 1900 MHz). Consequently, some embodiments may support wireless applications other than wireless microphones. Moreover, while the embodiments shown in FIGS. 1A-1D support dual bands, some embodiments may support more than two frequency bands, for example, tri-band or greater. FIG. 7 shows an alternative antenna example which is similar to antennas 101 and 202 dimensionally and functionally, in which like reference numerals refer to the same or similar elements in all of the various views in which the reference number appears. However, in this example, antenna 301 may support a tri-band operation by positioning appropriately sized slots 328, 330 in the antenna metal surface thereby creating an additional tab 316. The additional tab 316 can be configured to allow the antenna to operate in an ISM radio band of 5.8 GHz ISM in addition to ISM radio bands of 902-928 MHz and 2400-2485 MHz.

Figure 4:
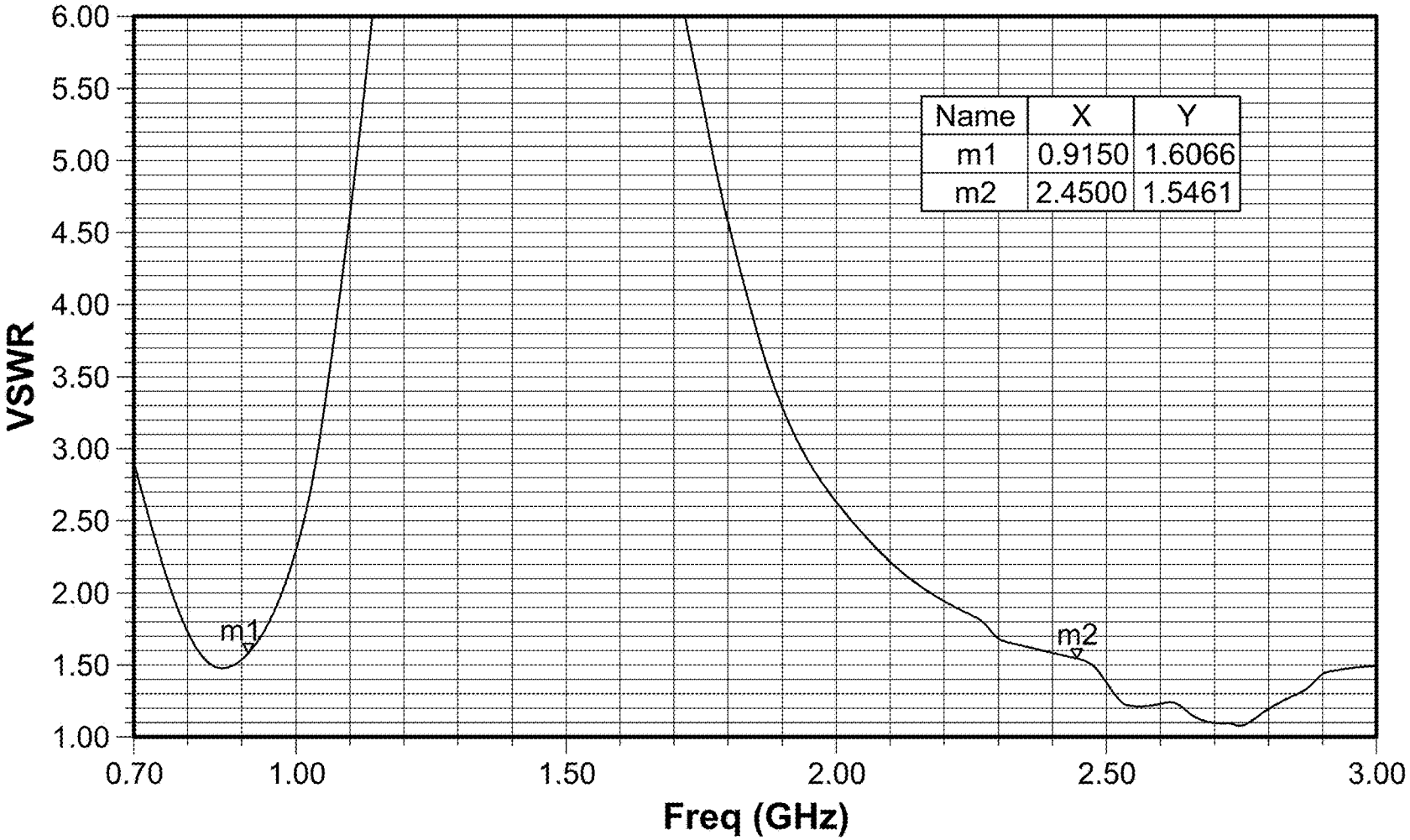
FIG. 4 illustrates a response graph of the example antenna of FIG. 1A.

FIG. 4 illustrates a VSWR response graph of the example antennas 101, 201. The response graph shown in FIG. 4 illustrates that the example antennas 101, 201 can be used in both the 900-928 MHz region and the 2400-2485 MHz region. In both of these regions the VSWR is less than 3, showing that the antenna is capable of operating in the two regions. However, a different VSWR criterion may be used determine the operating bandwidths. Additionally, as shown by FIG. 4, it is contemplated that the antenna is capable of supporting other frequency regions for example between 700 MHz to 1000 MHz and 1700 to 2700 MHz. Moreover, it is contemplated that the antennas 101, 201 can be further fined tuned to support additional bandwidths including 1600 MHz to 3500 MHz. This may be accomplished by altering the lengths and area of the existing tabs or by providing additional tabs. In this way, in certain examples, the antennas 101, 201 may be configured to support more than two distinct bandwidths.

Figure 5A:
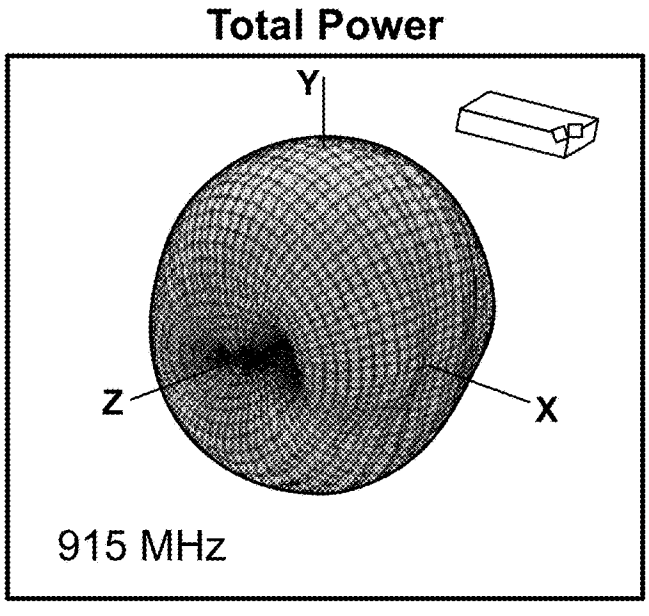
FIG. 5A illustrates the radiation pattern of the example antenna of FIG. 1A at 915 MHz.
Figure 5B:
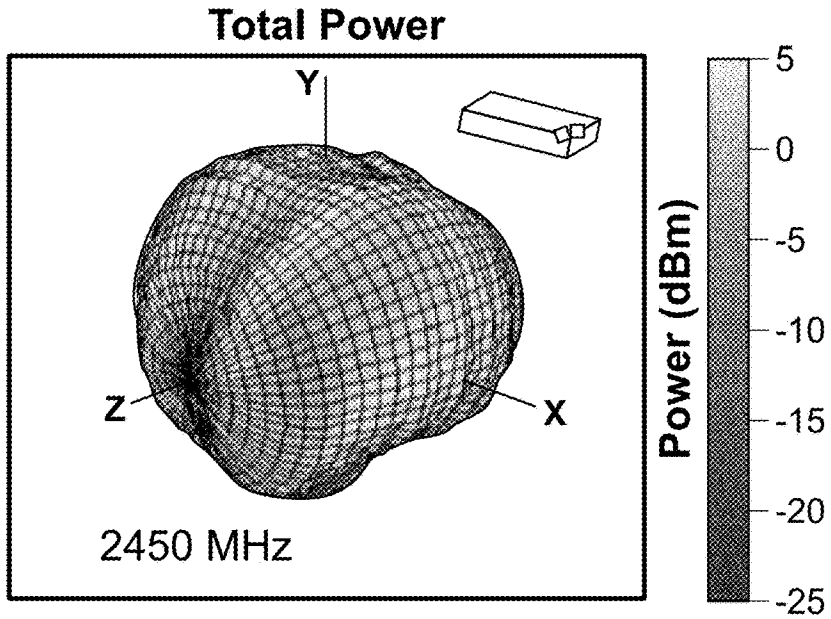
FIG. 5B illustrates the radiation pattern of the example antenna FIG. 1A at 2450 MHz.

FIGS. 5A and 5B further illustrate that the antennas 101, 201 are capable of operating in the two bandwidth regions of 915 MHz and 2450 MHz. As illustrated by the graphs, the antenna can adequately transmit signals in all directions. Measurements shown in FIGS. 5A-B are indicative that the embodiments of FIGS. 1A-D and 2A-C have gain characteristics that are substantively omni-directional in nature. This characteristic is also beneficial with wireless microphone systems, allowing the user to freely move and allowing dual-polarization, omni-like pattern coverage. This facilitates the use of the antennas 101, 201 in a wireless receiver system. For example, the user may not need to position the receiving antenna to establish communications between the wireless receiver and the wireless transmitter.

Figure 6A:
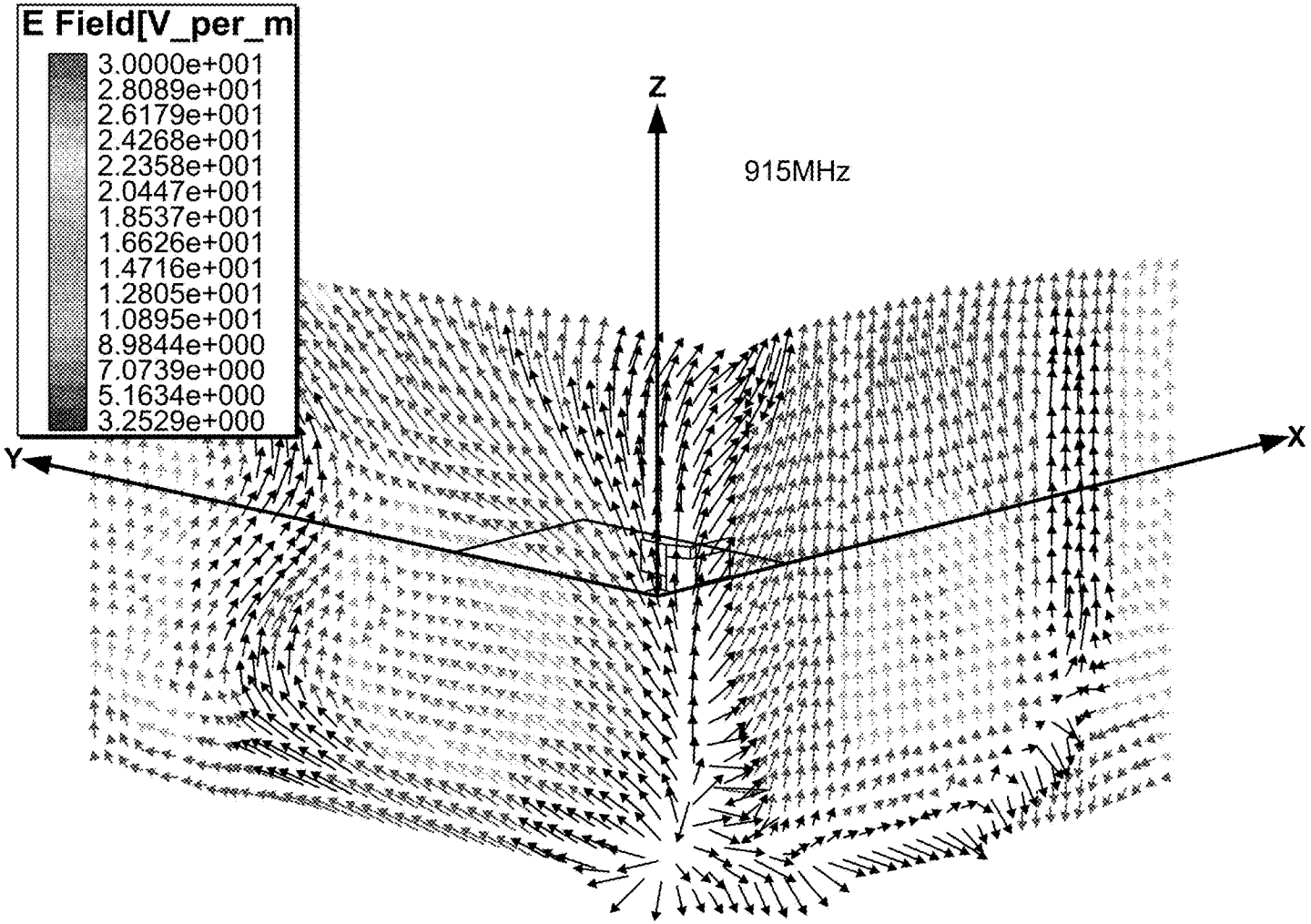
FIG. 6A shows the polarization characteristics of example antennas FIGS. 1A and 2A at 915 MHz.
Figure 6B:
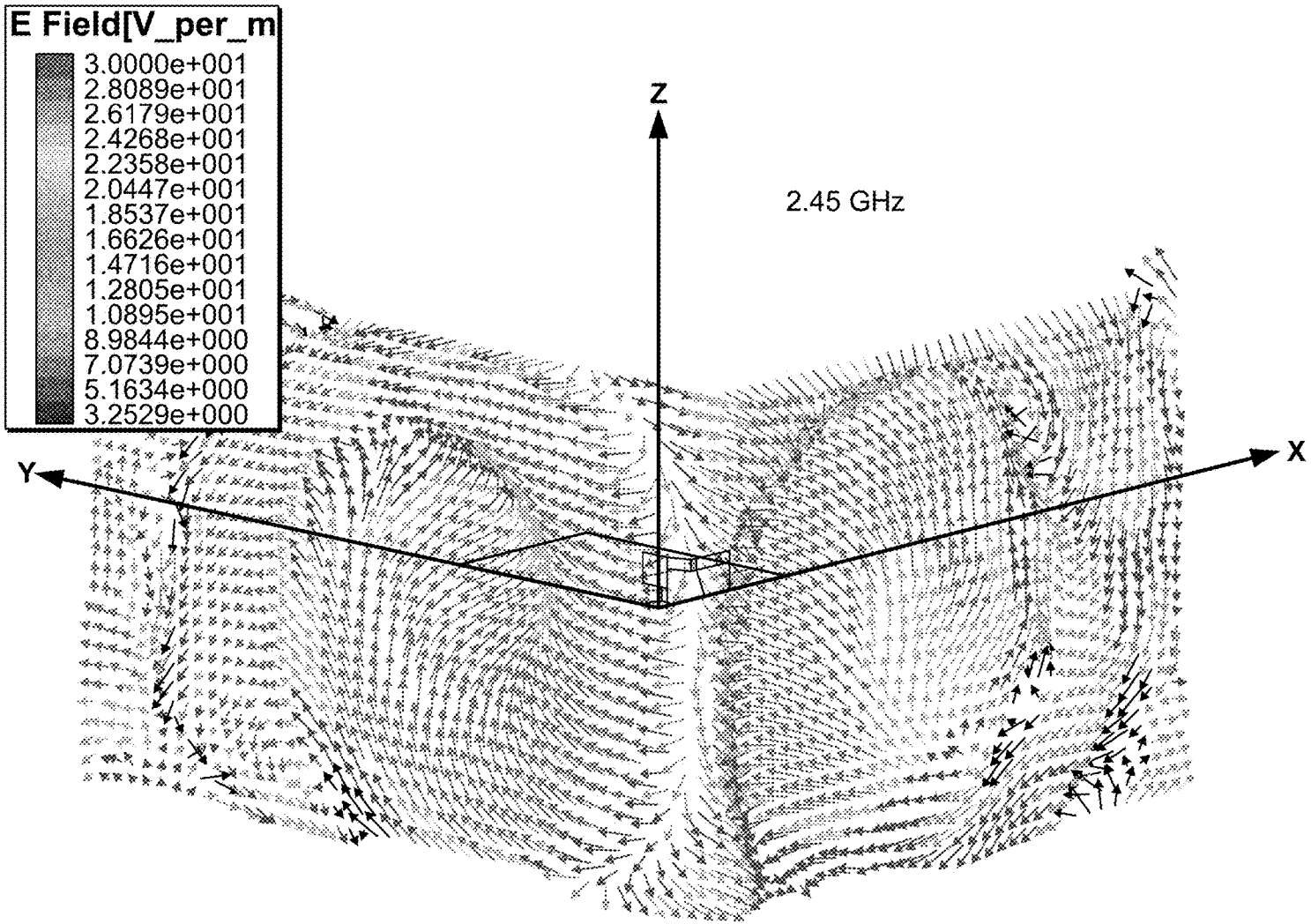
FIG. 6B shows the polarization characteristics of example antenna FIGS. 1A and 2A at 2450 MHz.

Referring to FIGS. 6A and 6B, computer simulations of the electric field (far field) suggest that the embodiments shown in FIGS. 1A-D and 2A-C have dual-polarization characteristics (both vertical and horizontal components). This characteristic is often beneficial to wireless microphone systems since transmitter polarization typically changes with user motion, where the transmitting wireless microphone may be in a vertical or horizontal position or somewhere in between. For example, as shown in FIG. 6A, the 900 MHz polarization (first radiator) is more vertical broadside to the planar element while on the other side, the "arm" (e.g. tab 103A, 203A) contributes to a strong horizontal component. Also, as shown in FIG. 6B, the 2450 MHz polarization (second radiator) has a circular polarization (consequently having both horizontal and vertical components).

In one example, an antenna for supporting a wireless system may include a first radiator configured to operate in a first frequency band, a second radiator configured to operate in a second frequency band, a single feed transmission section coupled to the first radiator and the second radiator, and a conductive connection configured to connect to a circuit board. The antenna may include a single metal sheet. The first frequency band may include a first industrial, scientific and medical ("ISM") frequency band and the second frequency band may include a second ISM frequency band. The first ISM frequency band can span the 900-928 MHz region and the second ISM band can span the 2400-2485 MHz region.

The first radiator and the second radiator may include multiple tabs having differing areas. A first one of the multiple tabs can generally extend along a first face of a chassis and a second one of the multiple tabs can generally extend along a second face of the chassis. The first radiator can generally follow an "L" shape. The first radiator and the second radiator can form an angle along a vertical axis. The angle can permit the antenna to conform to a chassis, and the angle can be at or between 140° to 180°. The first radiator and the second radiator can be formed from a single piece of sheet metal. The first radiator may include a plurality of tabs, and the plurality of tabs may each be angled relative to one another. A first one of the plurality of tabs and a second one of the plurality of tabs can form an angle at or between 100° to 135°. The first radiator can include a greater surface area than the second radiator. The first and second radiators may include dual-polarization characteristics. The first and second radiators may have omni-directional gain characteristics. In one example, the antenna may include a third radiator configured to operate at a third frequency band. Also the antenna can include a conductive connection, and the conductive connection can define a first area. The first and second radiators can define a second area, and the first area can be 5% to 10% of the second area.

In another example, a chassis can include a housing, a first antenna comprising a first radiator configured to operate in a first industrial, scientific and medical ("ISM") band and a second radiator configured to operate in a second ISM band, a feed transmission section coupled to the first radiator and the second radiator, a common feed line connected to both the first radiator and the second radiator, and a conductive connection, and a circuit board configured to receive the antenna. The housing may be configured to receive the circuit board and the antenna, and the conductive connection can be configured to connect to a circuit board. The housing may define a first face and a second face, the first face can extend perpendicular to the second face. A first one of the multiple tabs may extend generally along the first face of a chassis, and a second one of the multiple tabs can extend generally along the second face of the chassis. The first radiator and the second radiator can form an angle along a vertical axis and the angle may permit the antenna to fit within a first wall and a second wall of the chassis. The example chassis may include a second antenna, where the second antenna is mirror image of the first antenna. Also each of the first antenna and the second antenna may be formed of a second single stamped metal sheet. The first antenna and the second antenna can be configured to fit within the chassis.

Additionally, the circuit board may define a circuit board plane, and the first radiator and the second radiator may define multiple radiator planes. Also each of the multiple radiator planes can extend perpendicular to the circuit board plane. The conductive connection can define a first area, and the first radiator and the second radiator can define a second area, and the first area can be less than the second area. Additionally, the first area can be 5% to 10% of the second area. The first antenna and the second antenna can each be configured to receive a signal.

The present invention is disclosed above and in the accompanying drawings with reference to a variety of examples. The purpose served by the disclosure, however, is to provide examples of the various features and concepts related to the invention, not to limit the scope of the invention. While the disclosure has been described with respect to specific examples including presently preferred modes of carrying out the disclosure, those skilled in the art will appreciate that there are numerous variations and permutations of the above described systems and techniques that fall within the spirit and scope of the invention as set forth in the appended claims.

What is claimed is:

1. An antenna for supporting a wireless system, comprising:

a first radiator configured to operate in a first frequency band;

a second radiator configured to operate in a second frequency band;

a single feed transmission section coupled to the first radiator and the second radiator; and a conductive connection configured to connect to a circuit board, wherein:

the antenna comprises a single sheet, the first radiator and the second radiator comprise first and second tabs, respectively, the first and second tabs extend along first and second planes, respectively, and the first and second planes are approximately perpendicular to a plane of the circuit board.

2. The antenna of claim 1, wherein the first frequency band comprises a first industrial, scientific and medical ("ISM") frequency band and the second frequency band comprises a second ISM frequency band, wherein the first frequency band spans a 900-928 MHz region and the second frequency band spans a 2400-2485 MHz region.

3. The antenna of claim 1 wherein the first radiator comprises a plurality of tabs having differing areas and wherein the first tab of the first radiator generally extends along a first plane parallel to a first face of a chassis and the second tab of the second radiator generally extends along a second plane parallel to a second face of the chassis.

4. The antenna of claim 1 wherein the first radiator generally follows an "L" shape and the first radiator and the second radiator form an angle along a vertical axis.

5. The antenna of claim 4 wherein the angle permits the antenna to conform to a chassis, the angle being at or between 140° to 180°.

6. The antenna of claim 1 wherein the first radiator and the second radiator are formed from a single piece of sheet metal.

7. The antenna of claim 3 wherein the plurality of tabs are each angled relative to one another.

8. The antenna of claim 7 wherein a first one of the plurality of tabs and a second one of the plurality of tabs forms an angle at or between 100° to 135°.

9. The antenna of claim 1 wherein the first radiator comprises a greater surface area than the second radiator.

10. The antenna of claim 1 further comprising a third radiator configured to operate at a third frequency band.

11. The antenna of claim 1 further comprising a conductive connection wherein the conductive connection defines a first area and wherein the first and second radiators define a second area, the first area being 5% to 10% of the second area.

12. A chassis comprising:

a housing;

a first antenna comprising a first radiator, a second radiator, a feed transmission section coupled to the first radiator and the second radiator, and a conductive connection, and wherein the first antenna is a unitary planar structure; and a circuit board configured to receive the first antenna, wherein the housing is configured to receive the circuit board and the first antenna and the conductive connection is configured to connect to the circuit board, wherein the circuit board defines a circuit board planar face and the first radiator and the second radiator define a first radiator planar face and a second radiator planar face, respectively, and wherein the first and second radiator planar faces extend perpendicular to the circuit board planar face.

13. The chassis of claim 12 wherein the first antenna comprises multiple tabs, the housing defines a first face and a second face, the first face extending perpendicular to the second face and wherein a first one of the multiple tabs extends generally along a first plane parallel to the first face and a second one of the multiple tabs extends generally along a second plane parallel to the second face.

14. The chassis of claim 12 wherein the first radiator and the second radiator form an angle along a vertical axis, and the angle permits the first antenna to fit within a first wall and a second wall of the chassis and wherein the first radiator is spaced away from an edge of the circuit board.

15. The chassis of claim 12 further comprising a second antenna, wherein the second antenna is mirror image of the first antenna and each of the first antenna and the second antenna comprise a single stamped metal sheet, wherein the first antenna and the second antenna are configured to fit within the chassis, the first antenna and the second antenna are configured to receive a signal.

16. The chassis of claim 12 wherein the conductive connection defines a first area and the first radiator and the second radiator define a second area and wherein the first area is less than the second area.

17. The chassis of claim 16 wherein the first area is 5% to 10% of the second area.

18. A chassis comprising:

a housing defining a first wall and a second wall, the first wall extending perpendicular to the second wall;

a first antenna formed of a unitary planar structure comprising a first radiator configured to operate in a first industrial, scientific and medical ("ISM") band and a second radiator configured to operate in a second ISM band, a feed transmission section coupled to the first radiator and the second radiator, and a conductive connection, the first radiator and the second radiator forming an angle along a vertical axis and the angle permitting the first antenna to fit within the first wall and the second wall of the chassis; and a circuit board configured to receive the first antenna, wherein the housing is configured to receive the circuit board and the first antenna and the conductive connection is configured to connect to the circuit board, wherein the circuit board defines a circuit board planar face and the first radiator and the second radiator define first and second radiator planar faces, respectively, and wherein the first and second radiator planar faces extend perpendicular to the circuit board planar face.

* * * * *